US011154461B1

(12) United States Patent
Abbs et al.

(10) Patent No.: US 11,154,461 B1
(45) Date of Patent: Oct. 26, 2021

(54) CONNECTED MEDICATION DISPENSING SYSTEM

(71) Applicant: Abbs Steptoe Enterprises LLC, Chandler, AZ (US)

(72) Inventors: Dishon Abbs, Chandler, AZ (US); Michael Steptoe, Chandler, AZ (US); Ahdev Kuppusamy, Paradise Valley, AZ (US)

(73) Assignees: ABBS STEPTOE ENTERPRISES LLC, Chandler, AZ (US); AK MEDICAL MANAGEMENT SERVICES LLC, Scottsdale, AZ (US)

( * ) Notice: Subject to any disclaimer, the term of this patent is extended or adjusted under 35 U.S.C. 154(b) by 0 days.

(21) Appl. No.: 17/039,680

(22) Filed: Sep. 30, 2020

(51) Int. Cl.
*A61J 7/04* (2006.01)
*A61J 7/00* (2006.01)

(52) U.S. Cl.
CPC ..... *A61J 7/0445* (2015.05); *A61J 7/0076* (2013.01); *A61J 2200/70* (2013.01); *A61J 2205/00* (2013.01)

(58) Field of Classification Search
CPC .... A61J 1/1437; A61J 2200/70; A61J 7/0007; A61J 7/0084; A61J 7/0445
See application file for complete search history.

(56) References Cited

U.S. PATENT DOCUMENTS

2010/0049363 A1* 2/2010 Ratnakar ..... G16H 40/67 700/236
2014/0350720 A1* 11/2014 Lehmann ..... A61J 7/0481 700/236
2016/0158107 A1* 6/2016 Dvorak ..... A61J 7/0084 241/25

* cited by examiner

*Primary Examiner* — Gene O Crawford
*Assistant Examiner* — Ayodeji T Ojofeitimi
(74) *Attorney, Agent, or Firm* — Booth Udall Fuller, PLC

(57) ABSTRACT

A dispensing system comprising a main body, a carousel, and a shuttle. The carousel is configured to sequentially align each of a plurality of cartridges with a dispensing outlet of the dispensing system. The shuttle is configured to sequentially align each of a plurality of compartments of each cartridge with the dispensing outlet. The dispensing system is configured to dispense a dose only after a predetermined interval of time based on a prescription. In addition, the dispensing system is connected to a network to allow the prescriber to remotely modify the prescription. The dispensing system may additionally have a biometric scanner to verify the identity of a patient, an ID scanner to authorize a pharmacist to refill the dispensing system, and a plurality of tamper sensors to alert the prescriber or the pharmacist if a patient attempts to access the dispensing system without authorization.

18 Claims, 14 Drawing Sheets

CONNECTED MEDICATION DISPENSING SYSTEM

TECHNICAL FIELD

Aspects of this document relate generally to a dispensing system, and more specifically to a medication dispensing system that monitors each dispense.

BACKGROUND

Medication dispensers are used to provide doses of medication to a patient. The most basic medication dispensers are just pill bottles, often with a child-proof lid to prevent a child from accessing the medication. The more advanced medication dispensers try to provide additional help to the patient. For example, many patients become concerned about missing a dose. Thus, some medication dispensers notify the patient when it is time to take the medication. As another example, patients sometimes do not realize that their supply of medication is running low. Thus, some medication dispensers recognize the need for a refill and notify the pharmacy for the patient. Generally, the additional features added to advanced medication dispensers allow the medication dispenser to be used the same as the basic medication dispenser while providing the additional features.

SUMMARY

Aspects of this document relate to a dispensing system comprising a main body comprising a top cover, a cylindrical side wall, and a bottom cover, wherein the side wall has a dispensing outlet, a carousel within the main body, the carousel holding a plurality of cartridges, each of the cartridges having a plurality of compartments, the plurality of compartments each sized to hold a dose, wherein the carousel is configured to sequentially radially align each of the plurality of cartridges with the dispensing outlet of the side wall, a shuttle adjacent the carousel within the main body, wherein, when the carousel is in a first position, a first cartridge of the plurality of cartridges is radially aligned with the dispensing outlet of the side wall and the shuttle is configured to lift the first cartridge of the plurality of cartridges to sequentially vertically align each of the plurality of compartments of the first cartridge with the dispensing outlet of the side wall, and wherein, when the carousel is in a second position, a second cartridge of the plurality of cartridges is radially aligned with the dispensing outlet of the side wall and the shuttle is configured to lift the second cartridge of the plurality of cartridges to sequentially vertically align each of the plurality of compartments of the second cartridge with the dispensing outlet of the side wall, a biometric scanner disposed in the top cover and configured to recognize biometric data of a patient, verify the identity of the patient, and authorize a dispense from the dispensing system through the dispensing outlet, a device key configured to unlock the bottom cover and allow a pharmacist to open the dispensing system and fill each of the plurality of compartments, an ID scanner disposed on the top cover and configured to recognize an ID of the pharmacist and authorize use of the device key to unlock the bottom cover of the dispensing system, wherein the dispensing system is configured to dispense a dose only after a predetermined interval of time based on a prescription provided by a prescriber, wherein the dispensing system is communicatively coupled to a network and is configured to receive and implement a modified prescription from the prescriber.

Particular embodiments may comprise one or more of the following features. The system may further comprise an accelerometer disposed within the main body and configured to track movement and acceleration of the dispensing system. The system may further comprise a plurality of tamper sensors disposed within the main body and configured to alert a database if a patient attempts to gain access to the interior of the dispensing system without authorization. The system may further comprise an internal rechargeable battery disposed within the main body and configured to provide power to the carousel, the shuttle, the biometric scanner and the ID scanner. The shuttle driving motor may be configured to drive the shuttle and a carousel driving motor may be configured to rotate the carousel.

Aspects of this document relate to a dispensing system comprising a carousel holding a plurality of cartridges, each of the cartridges having a plurality of compartments, wherein the carousel is configured to sequentially align each of the plurality of cartridges with a dispensing outlet of the dispensing system, and a shuttle adjacent the carousel, wherein when the carousel is in a first position, a first cartridge of the plurality of cartridges is radially aligned with the dispensing outlet and the shuttle is configured to sequentially vertically align each of the plurality of compartments of the first cartridge with the dispensing outlet, wherein when the carousel is in a second position, a second cartridge of the plurality of cartridges is radially aligned with the dispensing outlet of the side wall and the shuttle is configured to sequentially vertically align each of the plurality of compartments of the second cartridge with the dispensing outlet, and wherein the dispensing system is configured to dispense a dose only after a predetermined interval of time based on a prescription provided by a prescriber.

Particular embodiments may comprise one or more of the following features. The system may further comprise a biometric scanner configured to recognize biometric data of a patient, verify the identity of the patient, and authorize a dispense from the dispensing system. The system may further comprise a device key and an ID scanner, wherein the device is configured to unlock the dispensing system and allow a pharmacist to open the dispensing system and fill each of the plurality of compartments and the ID scanner is configured to recognize an ID and authorize use of the device key to unlock the dispensing system. The dispensing system may be communicatively coupled to a network and may be configured to receive and implement a modified prescription from the prescriber. The system may further comprise a main body, a top cover, and a bottom cover, wherein the carousel and the shuttle are disposed within the main body and the dispensing outlet extends through a side wall of the main body. The system may further comprise a plurality of tamper sensors disposed within the main body and configured to alert a database if a patient attempts to gain access to the interior of the dispensing system without authorization.

Aspects of this document relate to a dispensing system comprising a main body comprising a top cover, a side wall, and a bottom cover, wherein the side wall has a dispensing outlet, and a plurality of compartments disposed within the main body, wherein the dispensing system is configured to sequentially align each of the plurality of compartments with the dispensing outlet, wherein the dispensing system is configured to dispense a dose only after a predetermined interval of time based on a prescription provided by a prescriber.

Particular embodiments may comprise one or more of the following features. The system may further comprise a biometric scanner exposed on the main body and configured to verify the identity of the patient and authorize a dispense from the dispensing system through the dispensing outlet. The system may further comprise a device key configured to unlock the main body and allow a pharmacist to open the dispensing system and fill each of the plurality of compartments. The system may further comprise an ID scanner exposed on the main body and configured to recognize an ID of the pharmacist and authorize use of the device key to unlock the bottom cover of the dispensing system. The system may further comprise a plurality of tamper sensors disposed within the main body and configured to alert a database if a patient attempts to gain access to the interior of the dispensing system without authorization. The dispensing system may be communicatively coupled to a network and may be configured to receive and implement a modified prescription from the prescriber. The system may further comprise a shuttle adjacent the carousel, the shuttle configured to sequentially vertically align each of the plurality of compartments with the dispensing outlet. When the carousel is in a first position, a first cartridge of the plurality of cartridges may be radially aligned with the dispensing outlet and the shuttle may be configured to sequentially vertically align each of the plurality of compartments of the first cartridge with the dispensing outlet, and when the carousel is in a second position, a second cartridge of the plurality of cartridges may be radially aligned with the dispensing outlet of the side wall and the shuttle may be configured to sequentially vertically align each of the plurality of compartments of the second cartridge with the dispensing outlet.

The foregoing and other aspects, features, applications, and advantages will be apparent to those of ordinary skill in the art from the specification, drawings, and the claims. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112(f). Thus, the use of the words "function," "means" or "step" in the Detailed Description or Description of the Drawings or claims is not intended to somehow indicate a desire to invoke the special provisions of 35 U.S.C. § 112(f), to define the invention. To the contrary, if the provisions of 35 U.S.C. § 112(f) are sought to be invoked to define the inventions, the claims will specifically and expressly state the exact phrases "means for" or "step for", and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. § 112(f). Moreover, even if the provisions of 35 U.S.C. § 112(f) are invoked to define the claimed aspects, it is intended that these aspects not be limited only to the specific structure, material or acts that are described in the preferred embodiments, but in addition, include any and all structures, materials or acts that perform the claimed function as described in alternative embodiments or forms of the disclosure, or that are well known present or later-developed, equivalent structures, material or acts for performing the claimed function.

The foregoing and other aspects, features, and advantages will be apparent to those of ordinary skill in the art from the specification, drawings, and the claims.

BRIEF DESCRIPTION OF THE DRAWINGS

Implementations will hereinafter be described in conjunction with the appended drawings, where like designations denote like elements, and.

Figure 1:
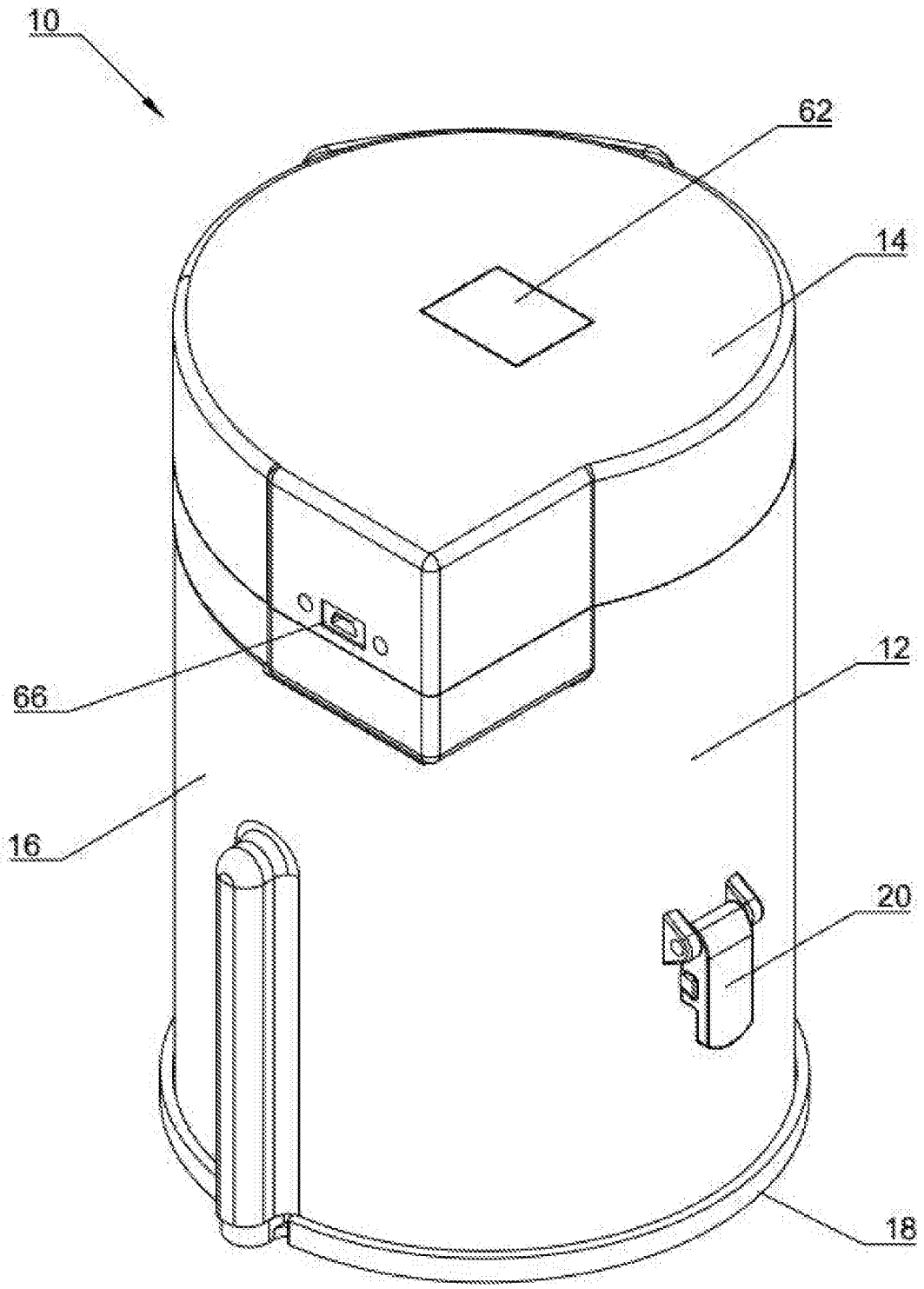
FIG. 1 is a perspective view of a medication dispensing system.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of implementations.

DETAILED DESCRIPTION

This disclosure, its aspects and implementations, are not limited to the specific material types, components, methods, or other examples disclosed herein. Many additional material types, components, methods, and procedures known in the art are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of implementations that are described in many different forms, there is shown in the drawings and will herein be described in detail particular implementations with the understanding that the present disclosure is to be considered as an exemplification of the principles of the disclosed methods and systems, and is not intended to limit the broad aspect of the disclosed concepts to the implementations illustrated.

In the following description, reference is made to the accompanying drawings which form a part hereof, and which show by way of illustration possible implementations. It is to be understood that other implementations may be utilized, and structural, as well as procedural, changes may be made without departing from the scope of this document. As a matter of convenience, various components will be described using exemplary materials, sizes, shapes, dimensions, and the like. However, this document is not limited to the stated examples and other configurations are possible and within the teachings of the present disclosure. As will become apparent, changes may be made in the function and/or arrangement of any of the elements described in the disclosed exemplary implementations without departing from the spirit and scope of this disclosure.

FIG. 1 illustrates a perspective view of an embodiment of a connected medication dispensing system 10. The medication dispensing system 10 is designed to facilitate filling a prescription by only allowing a dose to be dispensed from the dispensing system 10 according to the prescription schedule. The various features of the dispensing system 10 described below are focused on securing the device, preventing unauthorized users from accessing the contents of the device, and connecting the device to remote authorized individuals such as prescribers and pharmacists to notify them of any misuse of the device, as well as allow them to adjust the authorized use of the device remotely.

As shown in FIG. 1, the dispensing system 10 may have a main body 12 comprising a top cover 14, a side wall 16, and a bottom cover 18. The side wall 16 may be cylindrical and may have a dispensing outlet 20 extending through the side wall 16.

Figure 2:
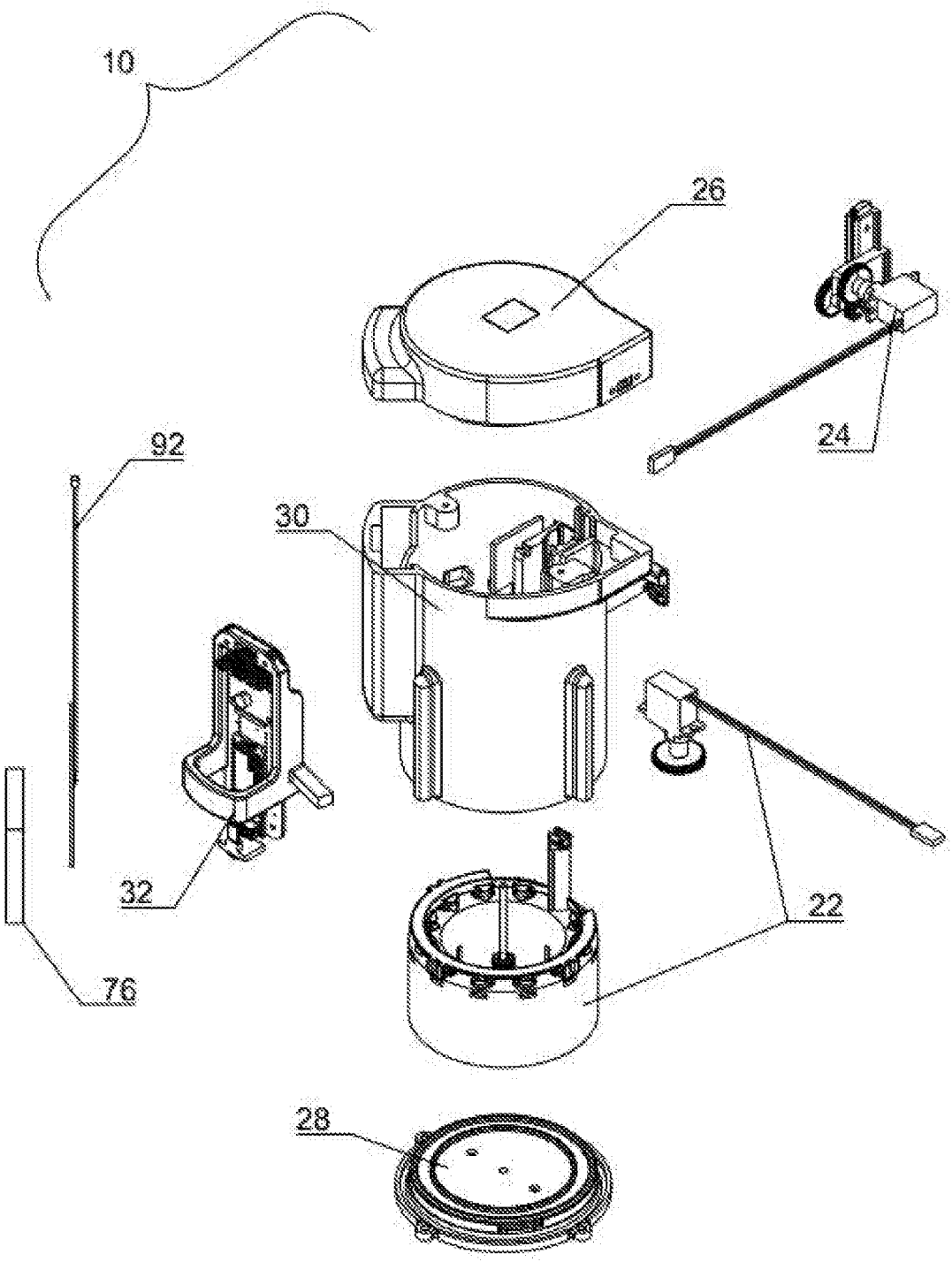
FIG. 2 is an exploded view of the medication dispensing system of FIG. 1 showing the various sub-assemblies.

FIG. 2 shows an exploded view of the medication dispensing system 10 of FIG. 1.

The dispensing system 10 comprises a carousel sub-assembly 22, a shuttle sub-assembly 24, a lid sub-assembly 26, a base sub-assembly 28, a housing sub-assembly 30, and an electronics sub-assembly 32. These sub-assemblies fit together to form the medication dispensing system 10 as shown. The individual exploded views in the figures that follow in FIGS. 3-8 further break up the sub-assemblies shown in FIG. 2.

Figure 3:
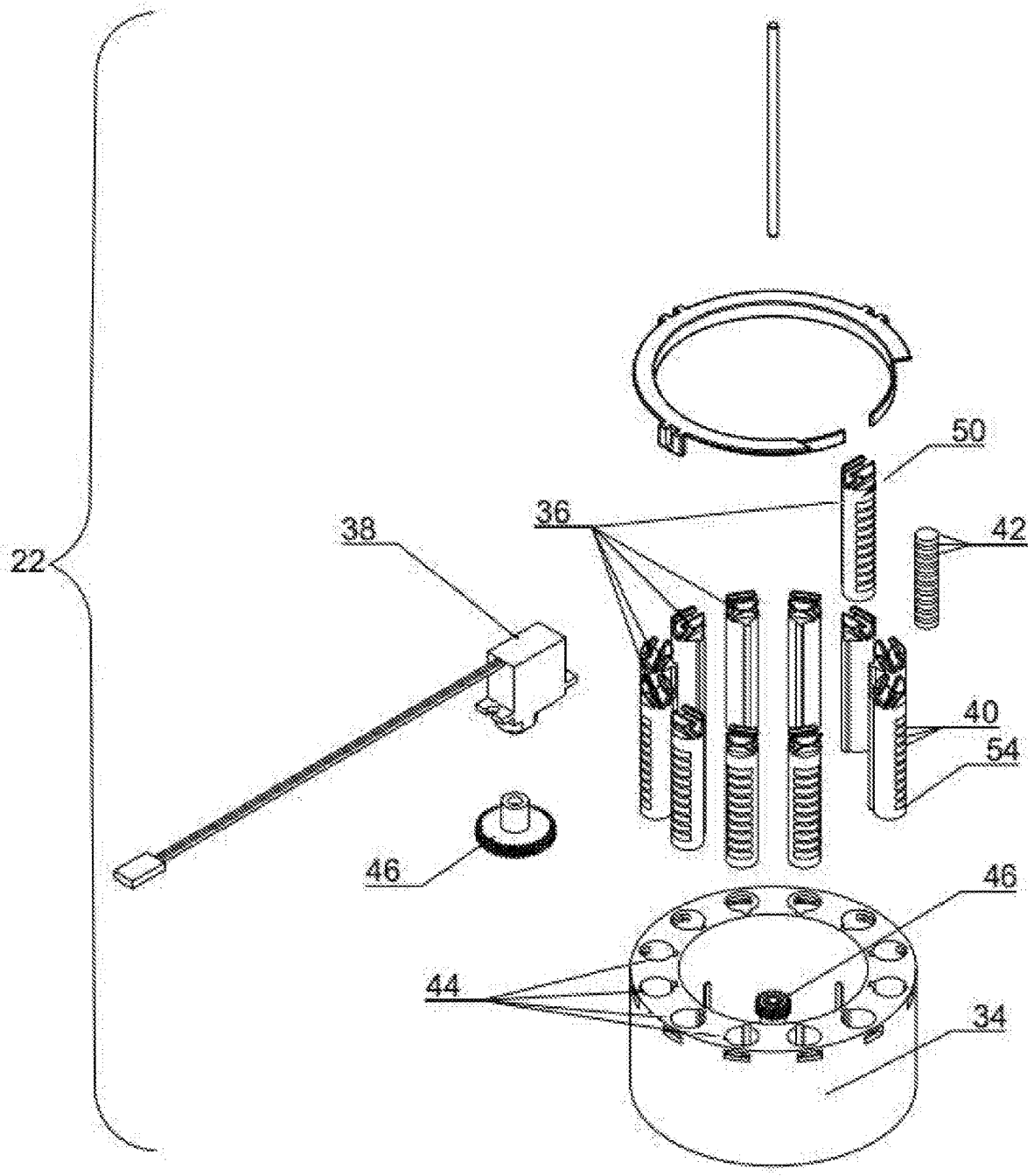
FIG. 3 is an exploded view of the carousel sub-assembly of the medication dispensing system shown in FIG. 2.

FIG. 3 illustrates an exploded view of the carousel sub-assembly 22. The carousel sub-assembly 22 fits within the main body 12. The carousel sub-assembly 22 comprises a carousel 34, a plurality of cartridges 36, and a carousel driving motor 38. Each cartridge of the plurality of cartridges 36 has a plurality of compartments 40 that are sized to hold a dose 42. Depending on the medication with which the dispensing system 10 is intended to be used, the plurality of compartments 40 may be sized larger or smaller to accommodate the size of the dose 42. The carousel 34 is configured to hold the plurality of cartridges 36. For example, as shown in FIG. 3, the carousel may have a plurality of cartridge seats 44, each of which is configured to hold one of the plurality of cartridges 36. The carousel driving motor 38 may be rotationally coupled to the carousel 34 through one or more gears 46. Alternatively, the carousel driving motor 38 may be directly rotationally coupled to the carousel 34 such that the rotation of the carousel driving motor 38 causes the carousel 34 to rotate without the use of any gears 46.

The carousel 34 is configured to sequentially radially align each of the plurality of cartridges 36 with the dispensing outlet 20 of the side wall 16. For example, the carousel 34 may be in a first position 48 with a first cartridge 50 of the plurality of cartridges 36 aligned with the dispensing outlet 20. Once the first cartridge 50 has been emptied of all of the doses 42 stored within the plurality of compartments 40 of the first cartridge 50, the carousel 34 is configured to rotate or move to a second position 52 with a second cartridge 54 of the plurality of cartridges 36 aligned with the dispensing outlet 20. The carousel 34 is configured to continue this pattern of aligning a cartridge of the plurality of cartridges 36 with the dispensing outlet 20 for each of the plurality of cartridges 36.

Figure 4:
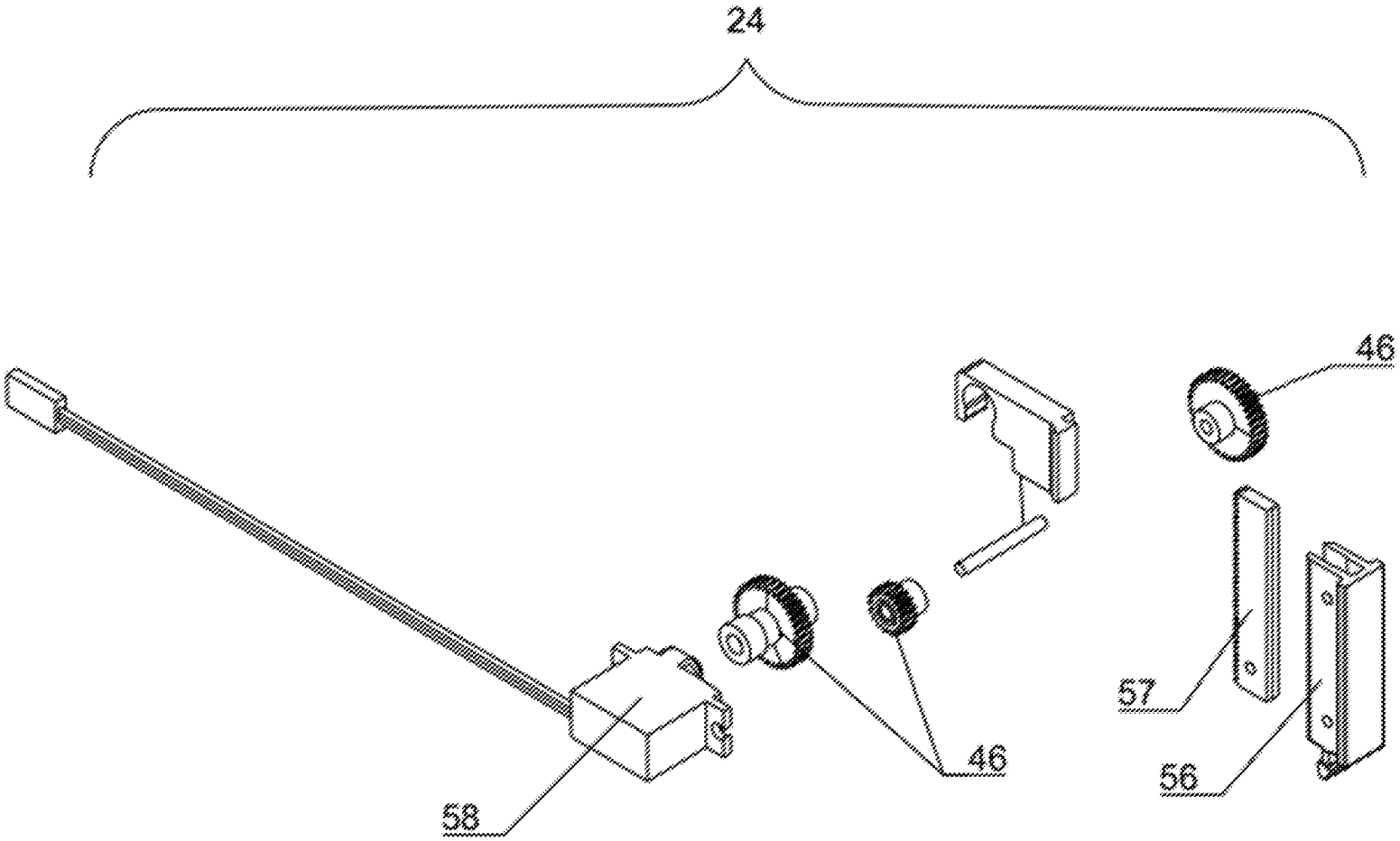
FIG. 4 is an exploded view of the shuttle sub-assembly of the medication dispensing system shown in FIG. 2.

FIG. 4 illustrates an exploded view of the shuttle sub-assembly 24. The shuttle sub-assembly fits within the main body 12. The shuttle sub-assembly comprises a shuttle 56 and a shuttle driving motor 58. The shuttle 56 may have a plurality of teeth 57 arranged linearly along an edge of the shuttle 56 that are configured to mesh with a gear 46. The shuttle driving motor 58 may operationally couple with the shuttle 56 through a gear 46. Because the teeth 57 of the shuttle 56 are arranged linearly, the rotational motion of the shuttle driving motor 58 is transferred to the gear 46 and then converted to linear motion of the shuttle 56. Alternatively, the shuttle driving motor 58 may be directly coupled to the shuttle 56 without the use of a gear 46.

The shuttle 56 is configured to sequentially vertically align each of the plurality of compartments 40 of each of the plurality of cartridges 36 with the dispensing outlet 20 of the side wall 16. For example, when the carousel 34 is in the first position 48, the first cartridge 50 is radially aligned with the dispensing outlet 20. The shuttle 56 is configured to lift the first cartridge 50 to align a first compartment 60 of the plurality of compartments 40 with the dispensing outlet 20. The dispensing system 10 is then configured to dispense the dose 42 within the first compartment 60 through the dispensing outlet 20. The shuttle 56 is configured to lift the first cartridge 50 further to align the next compartment of the plurality of compartments 40 with the dispensing outlet 20. The shuttle 56 is configured to continue this pattern of aligning a compartment of the plurality of compartments 40 with the dispensing outlet 20 for each of the plurality of compartments 40 on the first cartridge 50. Once the first cartridge 50 is emptied of all doses 42, the shuttle 56 is configured to lower the first cartridge 50 back onto the corresponding cartridge seat 44, and the carousel 34 moves to the second position 52. Once the carousel 34 moves to the second position 52, the pattern is repeated for the second cartridge 54. Each of the plurality of cartridges 36 may go through the same pattern of sequentially aligning each of the plurality of compartments 40 with the dispensing outlet 20.

Figure 5:
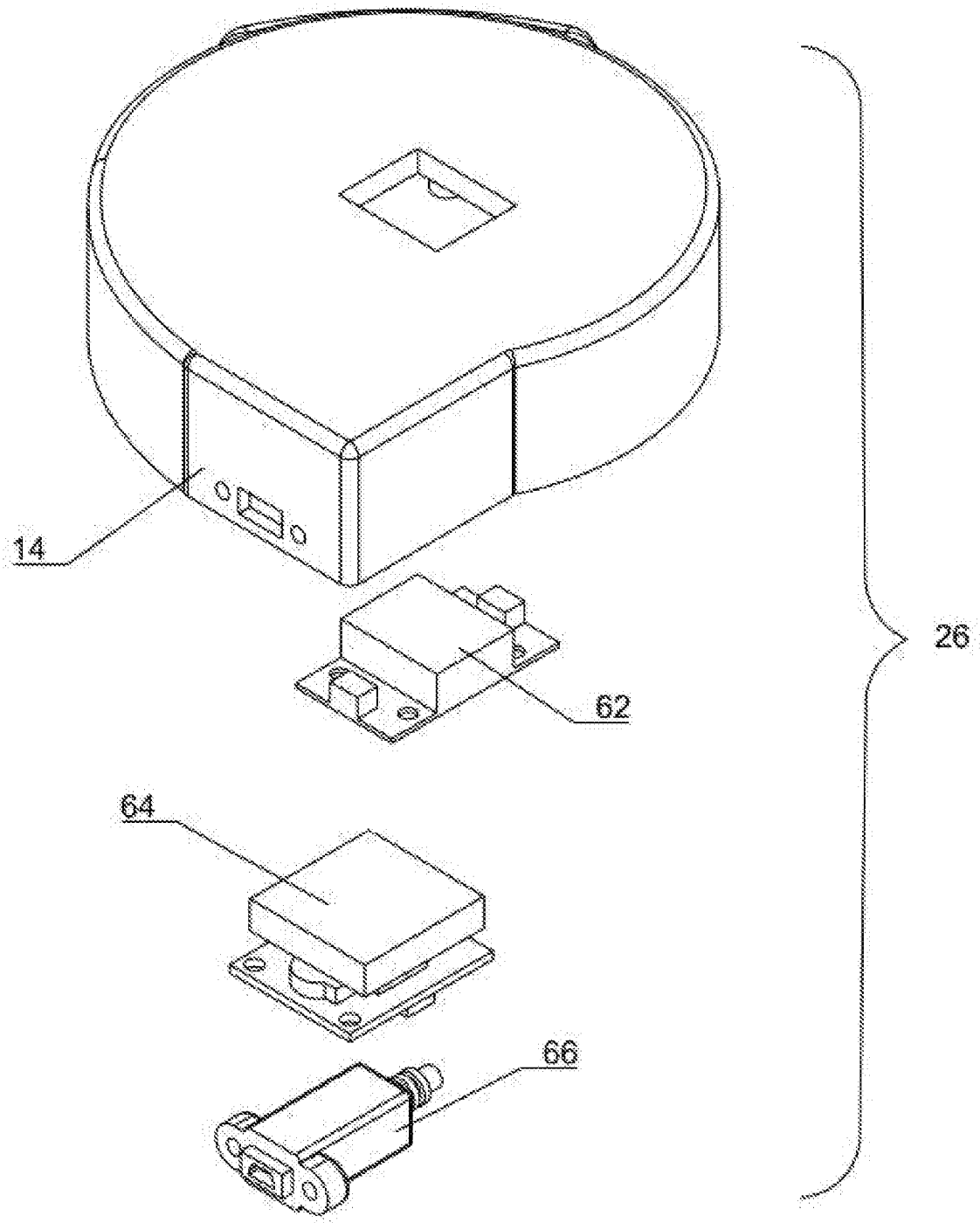
FIG. 5 is an exploded view of the lid sub-assembly of the medication dispensing system shown in FIG. 2.

FIG. 5 illustrates an exploded view of the lid sub-assembly 26. The lid sub-assembly 26 comprises the top cover 14, a biometric scanner 62, an ID scanner 64, and a micro-USB charging port 66. The biometric scanner 62 may be disposed in the top cover 14 and is configured to recognize biometric data 68 of a patient 70. Biometric data 68 may include facial features, fingerprints, vocal features, or other features that are unique to an individual. In an embodiment of the dispensing system 10 in which the biometric data 68 is fingerprint data, the patient 70 may place a finger on the biometric scanner 62. The biometric scanner 62 is configured to recognize the biometric data 68 (a fingerprint in this case) of the patient 70 and verify the identity of the patient 70 using the biometric data 68. If the patient 70 is authorized to take the medication, the biometric scanner 62 authorizes a dispense from the dispensing system 10 through the dispensing outlet 20.

Figure 12:
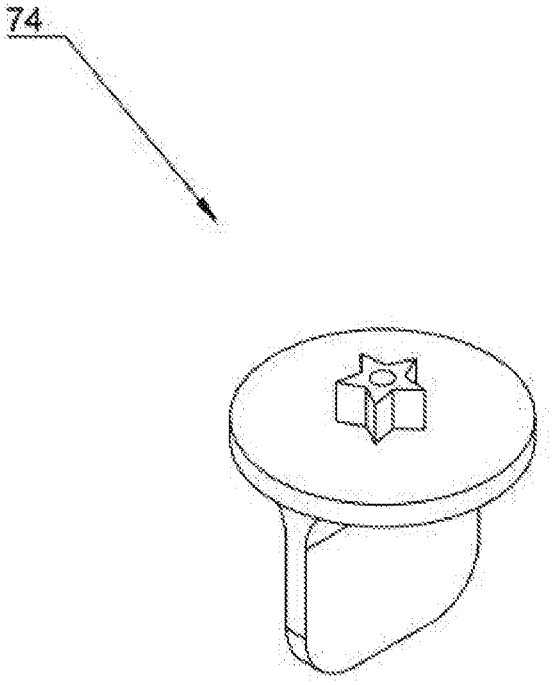
FIG. 12 is a perspective view of a device key used to open the bottom cover of the medication dispensing system of FIG. 1.

The ID scanner 64 may also be disposed in the top cover 14. The ID scanner 64 is configured to recognize an identification card ("ID") of a pharmacist 72. Once a pharmacist scans his or her ID, the ID scanner 64 authorizes use of a device key 74 (see FIG. 12) to unlock the bottom cover 18 of the dispensing system 10. Before a pharmacist's ID has been scanned by the ID scanner 64, any attempt to open the bottom cover 18 using the device key 74 will not be successful. The pharmacist may scan the ID and open the bottom cover 18 of the dispensing system 10 to fill each of the plurality of compartments 40 with a dose 42 of medication.

The micro-USB charging port 66 may be exposed through the side wall 16 of the main body 12 adjacent the top cover 14, or it could be located at any other suitable location conducive to charging. The micro-USB charging port 66 is configured to electrically charge an internal rechargeable battery 76 within the main body 12 of the dispensing system 10 (see FIG. 1). The internal rechargeable battery 76 is configured to provide power to at least the carousel 34, the shuttle 56, the biometric scanner 62, and the ID scanner 64. Other components of the dispensing system 10 may also be electrically coupled with the internal rechargeable battery 76 to allow the internal rechargeable battery 76 to provide power to these additional components.

Figure 6:
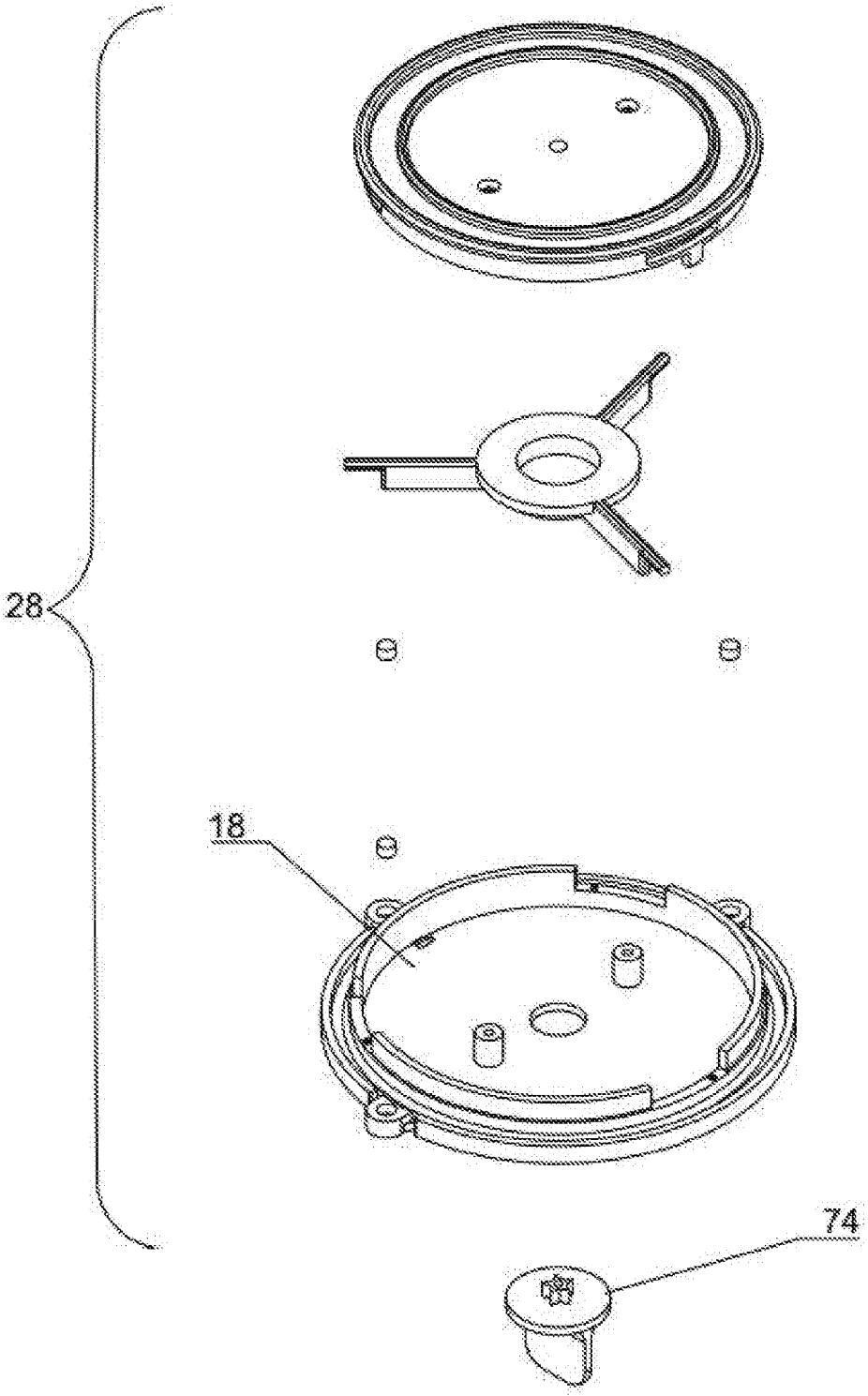
FIG. 6 is an exploded view of the base sub-assembly of the medication dispensing system shown in FIG. 2.

FIG. 6 illustrates an exploded view of the base sub-assembly 28. The base sub-assembly 28 includes the bottom cover 18, the device key 74, and additional components configured to support the dispensing system 10.

Figure 7:
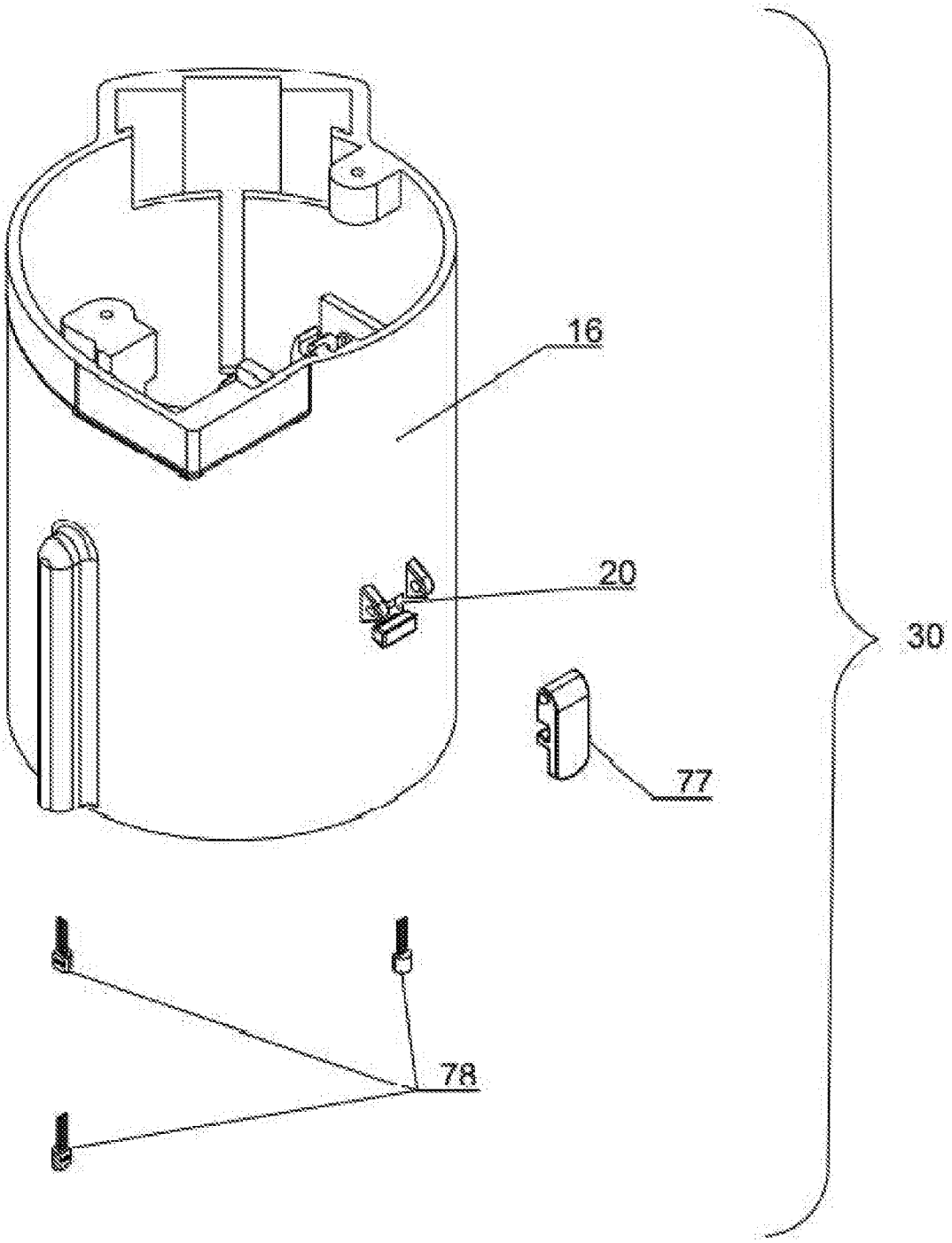
FIG. 7 is an exploded view of the housing sub-assembly of the medication dispensing system shown in FIG. 2.

FIG. 7 illustrates an exploded view of the housing sub-assembly 30. The housing sub-assembly 30 comprises the side wall 16, the dispensing outlet 20 with a dispensing outlet cover 77, and a plurality of tamper sensors 78 disposed adjacent the side wall 16. The plurality of tamper sensors 78 are configured to confirm that the bottom cover 18 is installed correctly and alert the pharmacist 72 if the bottom cover 18 is not installed correctly. In addition, the plurality of tamper sensors 78 are configured to alert a database 80 if the patient 70 attempts to gain access to the interior of the dispensing system 10 without authorization.

The dispensing system 10 and the database 80 are connected; communicatively coupled to a network 82 to allow communication with a prescriber 84 or a pharmacist 72. The dispensing system 10 is configured to dispense a dose 42 of medication only after a predetermined interval of time that is based on a prescription 86 provided by the prescriber 84. The prescriber 84 may remotely modify the prescription 86 through the network 82. The dispensing system 10 is configured to receive and implement the modified prescription 86. Thus, the prescriber 84 may remotely change the number of doses 42 available at once, as well as the length of the predetermined interval of time. The database 80 may notify the pharmacist 72 or the prescriber 84 or both through the network 82 of any unauthorized dispense.

Figure 8:
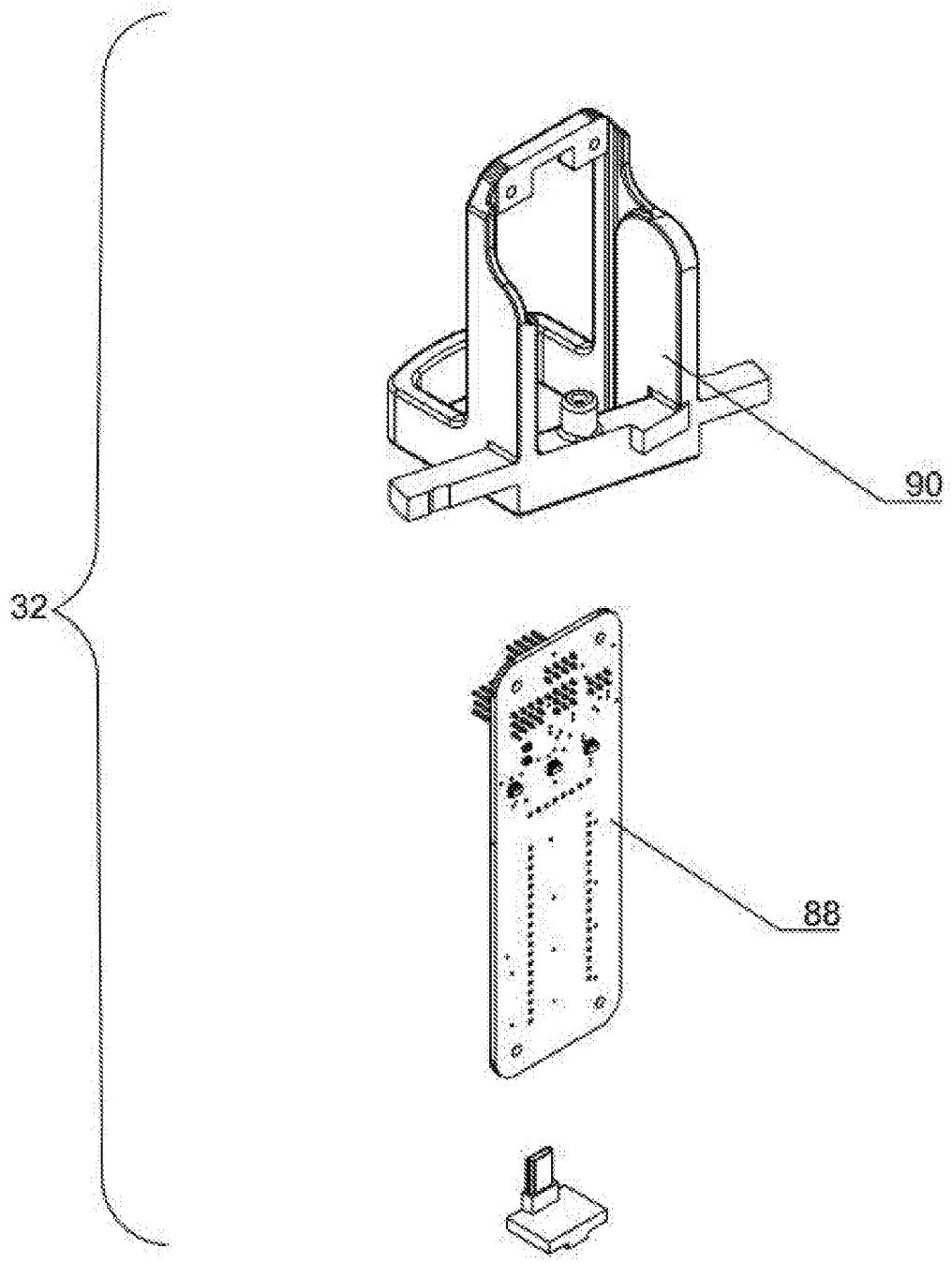
FIG. 8 is an exploded view of the electronics sub-assembly of the medication dispensing system shown in FIG. 2.

FIG. 8 is an exploded view of the electronics sub-assembly 32. The electronics sub-assembly comprises a circuit 88 and an internal support 90 configured to provide structural support to the circuit 88 and additionally provide structure to the other internal components of the dispensing system 10.

Figure 9A:
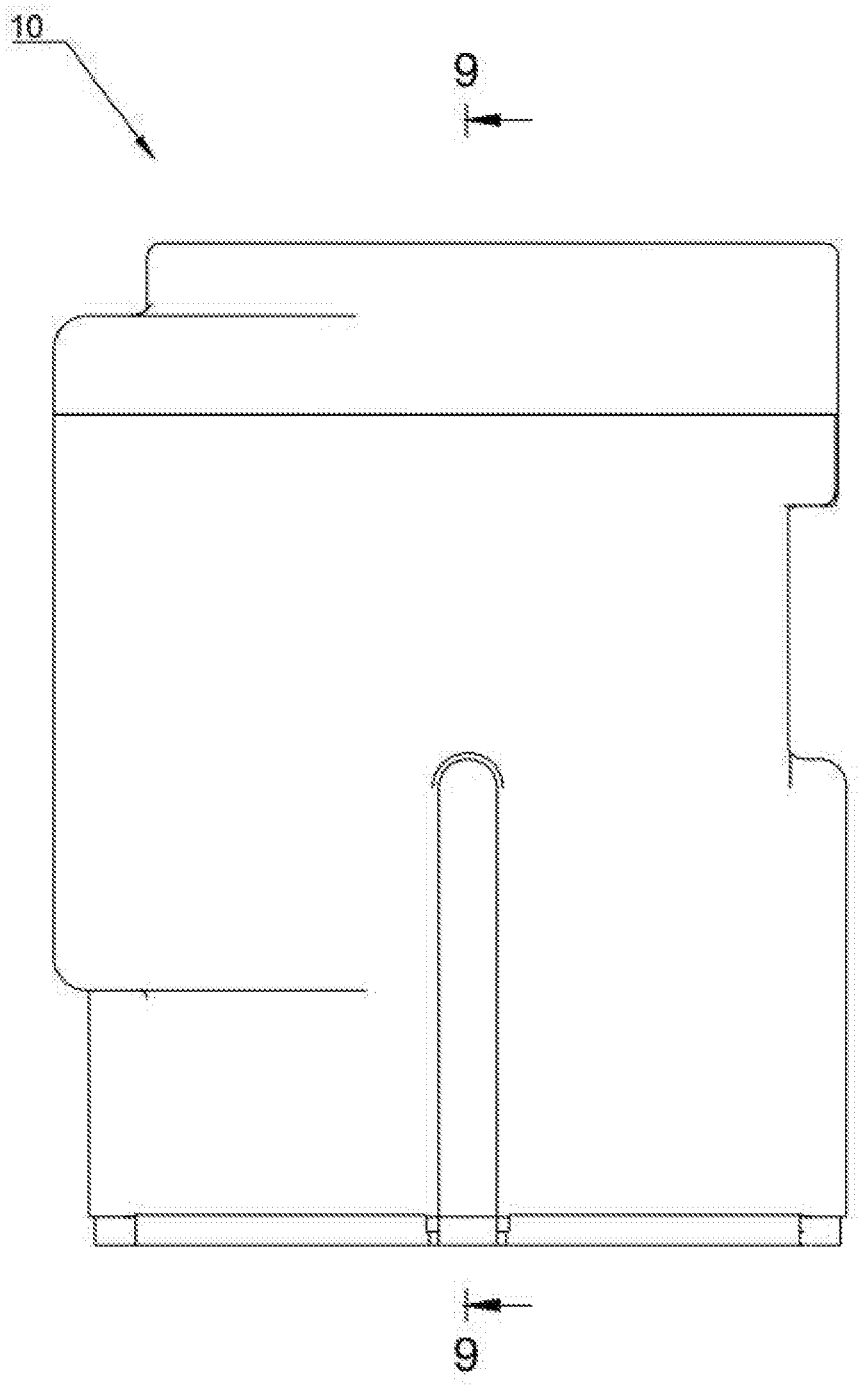
FIG. 9A is a side view of the medication dispensing system of FIG. 1.
Figure 9B:
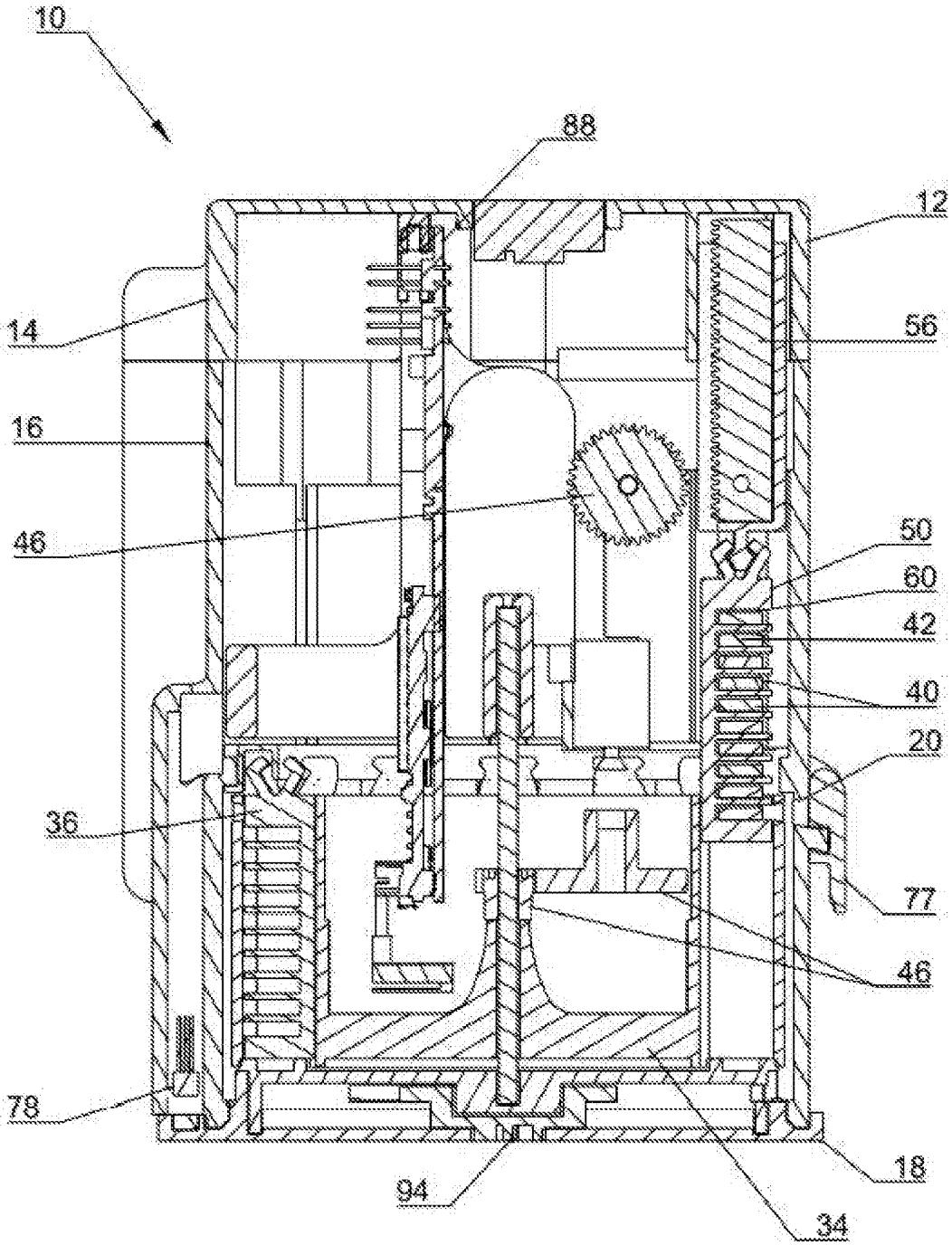
FIG. 9B is a vertical cross section of the medication dispensing system taken along line 9-9 in FIG. 9A.
Figure 10A:
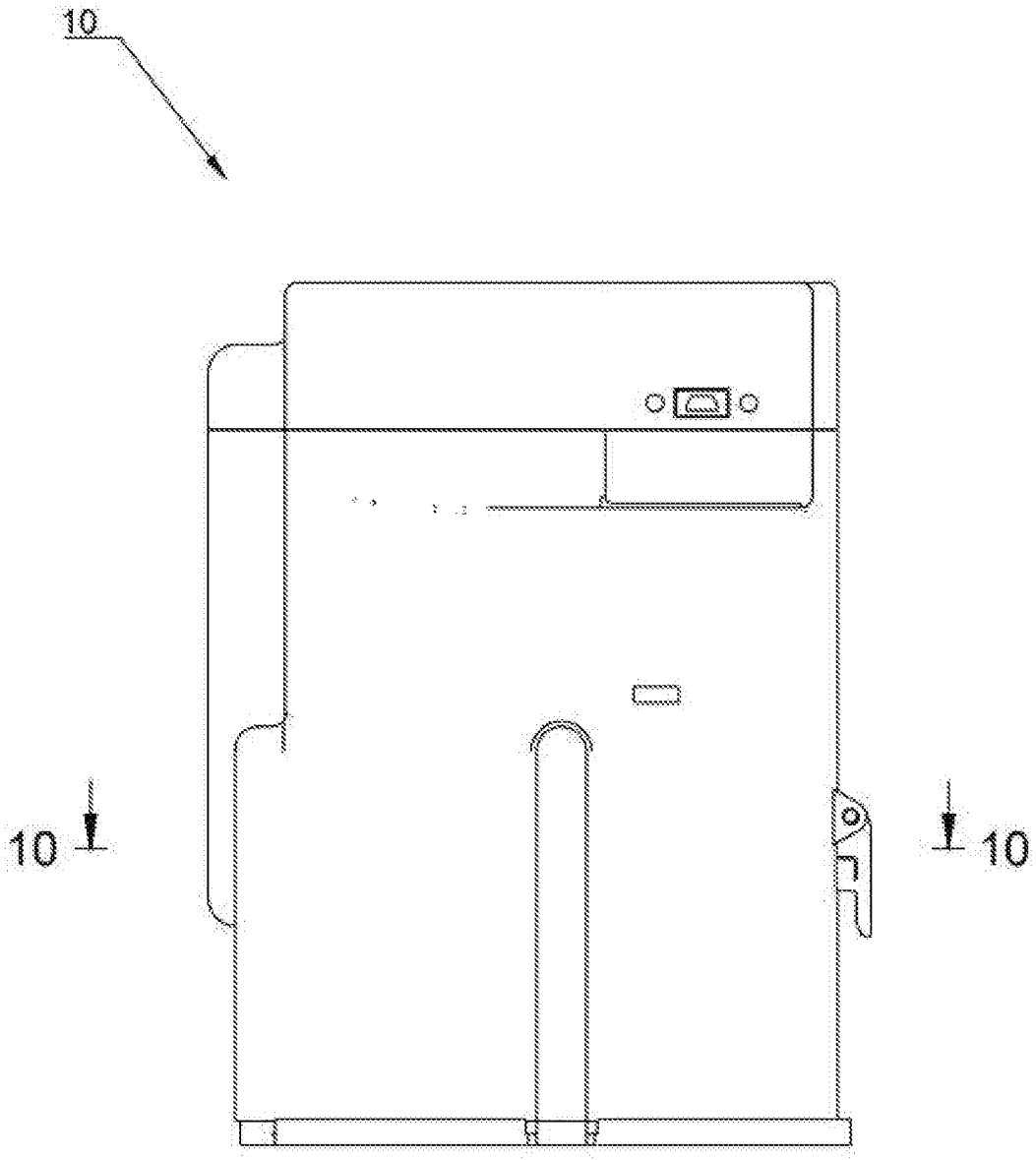
FIG. 10A is a side view of the medication dispensing system of FIG. 1.
Figure 10B:
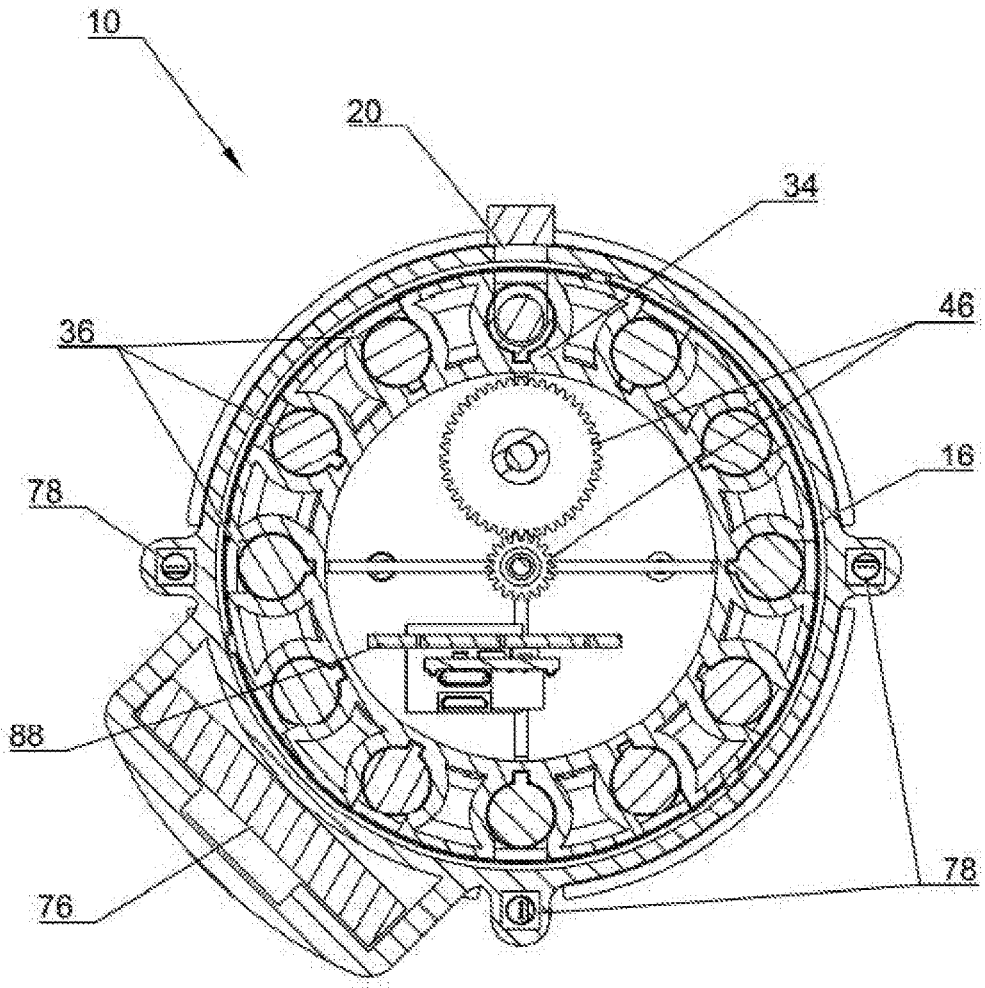
FIG. 10B is a horizontal cross section of the medication dispensing system taken along line 10-10 in FIG. 10A.

FIGS. 9A-9B illustrate the internal structure of the dispensing system 10 once all of the sub-assemblies are assembled together, as viewed from the side. FIGS. 10A-10B illustrate the internal structure of the dispensing system 10 once all of the sub-assemblies are assembled together, as viewed from the top. The dispensing system 10 may have an accelerometer 92 disposed within main body 12 (see FIG. 1). The accelerometer 92 may be configured to track movement and acceleration of the dispensing system 10. This information may be provided to the pharmacist 72 or the prescriber 84 through a connection to the network 82 such as a cellular tower. Other information gathered by the dispensing system 10 may be communicated to the network 82 as well to enhance the medical care that can be provided to the patient 70. As discussed above, the prescription 86 for the patient 70 may be modified remotely by the prescriber 84. Because the dispensing system 10 is connected to the network 82, the dispensing system 10 can automatically begin administering the modified prescription 86 without having to be reloaded or taken into the pharmacist 72 for modification.

Figure 11:
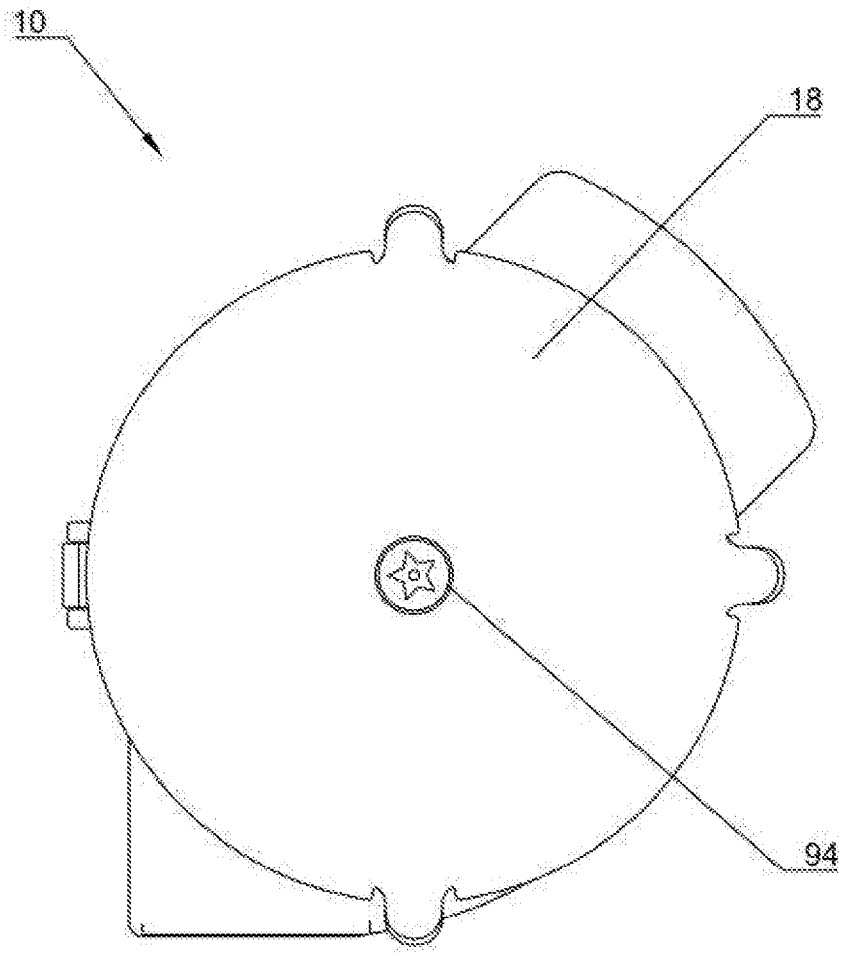
FIG. 11 is a bottom view of the medication dispensing system of FIG. 1.

FIG. 11 is a bottom view of the dispensing system 10. As shown, the dispensing system 10 may have a keyhole 94 configured to allow a pharmacist 72 to access the interior of the dispensing system 10 using the device key 74. While a star shape is shown, keyhole 94 and device key 74 may have any other rectilinear or even curvilinear shape.

Generally, the dispensing system 10 provides additional security and limits misuse of the medication stored within the dispensing system 10. For example, the dispensing system 10 is tamper-evident and notifies interested parties, such as the prescriber 84, the payor, and the pharmacist 72, of any attempt to access the interior of the dispensing system 10 without authorization. In addition, the dispensing system 10 uses a combination of software and hardware to enable access to the medication in the specific quantity and frequency prescribed, and the prescription 86 may be modified remotely. A dose 42 cannot be accessed prior to the next schedule time for taking the medication. Thus, the use of controlled substances can be carefully monitored and patients can be provided with improved healthcare through use of the dispensing system 10.

It will be understood that implementations of a medication dispensing system are not limited to the specific assemblies, devices and components disclosed in this document, as virtually any assemblies, devices and components consistent with the intended operation of a medication dispensing system. Accordingly, for example, although particular medication dispensing systems, and other assemblies, devices and components are disclosed, such may include any shape, size, style, type, model, version, class, measurement, concentration, material, weight, quantity, and/or the like consistent with the intended operation of medication dispensing systems. Implementations are not limited to uses of any specific assemblies, devices and components; provided that the assemblies, devices and components selected are consistent with the intended operation of a medication dispensing system.

Accordingly, the components defining any medication dispensing system implementations may be formed of any of many different types of materials or combinations thereof that can readily be formed into shaped objects provided that the components selected are consistent with the intended operation of a medication dispensing system implementation. For example, the components may be formed of: polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; glasses (such as quartz glass), carbon-fiber, aramid-fiber, any combination thereof, and/or other like materials; composites and/or other like materials; metals, such as zinc, magnesium, titanium, copper, lead, iron, steel, carbon steel, alloy steel, tool steel, stainless steel, brass, nickel, tin, antimony, pure aluminum, 1100 aluminum, aluminum alloy, any combination thereof, and/or other like materials; alloys, such as aluminum alloy, titanium alloy, magnesium alloy, copper alloy, any combination thereof, and/or other like materials; any other suitable material; and/or any combination of the foregoing thereof. In instances where a part, component, feature, or element is governed by a standard, rule, code, or other requirement, the part may be made in accordance with, and to comply under such standard, rule, code, or other requirement.

Various medication dispensing systems may be manufactured using conventional procedures as added to and improved upon through the procedures described here. Some components defining a medication dispensing system may be manufactured simultaneously and integrally joined with one another, while other components may be purchased pre-manufactured or manufactured separately and then assembled with the integral components. Various implementations may be manufactured using conventional procedures as added to and improved upon through the procedures described here.

Accordingly, manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components.

It will be understood that medication dispensing systems are not limited to the specific order of steps as disclosed in this document. Any steps or sequence of steps of the assembly of a medication dispensing system indicated herein are given as examples of possible steps or sequence of steps and not as limitations, since various assembly processes and sequences of steps may be used to assemble medication dispensing systems.

The implementations of a medication dispensing system described are by way of example or explanation and not by way of limitation. Rather, any description relating to the foregoing is for the exemplary purposes of this disclosure, and implementations may also be used with similar results for a variety of other applications employing a medication dispensing system.

What is claimed is:

1. A dispensing system, comprising:

a main body comprising a top cover, a cylindrical side wall, and a bottom cover, wherein the side wall has a dispensing outlet;

a carousel within the main body, the carousel holding a plurality of cartridges, each of the cartridges having a plurality of compartments, the plurality of compartments each sized to hold a dose, wherein the carousel is configured to sequentially radially align each of the plurality of cartridges with the dispensing outlet of the side wall;

a shuttle adjacent the carousel within the main body, wherein, when the carousel is in a first position, a first cartridge of the plurality of cartridges is radially aligned with the dispensing outlet of the side wall and the shuttle is configured to lift the first cartridge of the plurality of cartridges to sequentially vertically align each of the plurality of compartments of the first cartridge with the dispensing outlet of the side wall; and wherein, when the carousel is in a second position, a second cartridge of the plurality of cartridges is radially aligned with the dispensing outlet of the side wall and the shuttle is configured to lift the second cartridge of the plurality of cartridges to sequentially vertically align each of the plurality of compartments of the second cartridge with the dispensing outlet of the side wall;

a biometric scanner disposed in the top cover and configured to recognize biometric data of a patient, verify the identity of the patient, and authorize a dispense from the dispensing system through the dispensing outlet;

a device key configured to unlock the bottom cover and allow a pharmacist to open the dispensing system and fill each of the plurality of compartments; and an ID scanner disposed on the top cover and configured to recognize an ID of the pharmacist and authorize use of the device key to unlock the bottom cover of the dispensing system;

wherein the dispensing system is configured to dispense a dose only after a predetermined interval of time based on a prescription provided by a prescriber, wherein the dispensing system is communicatively coupled to a network and is configured to receive and implement a modified prescription from the prescriber.

2. The dispensing system of claim 1, further comprising an accelerometer disposed within the main body and configured to track movement and acceleration of the dispensing system.

3. The dispensing system of claim 1, further comprising a plurality of tamper sensors disposed within the main body and configured to alert a database if a patient attempts to gain access to the interior of the dispensing system without authorization.

4. The dispensing system of claim 1, further comprising an internal rechargeable battery disposed within the main body and configured to provide power to the carousel, the shuttle, the biometric scanner and the ID scanner.

5. The dispensing system of claim 1, wherein a shuttle driving motor is configured to drive the shuttle and a carousel driving motor is configured to rotate the carousel.

6. A dispensing system, comprising:

a carousel holding a plurality of cartridges, each of the cartridges having a plurality of compartments, wherein the carousel is configured to sequentially align each of the plurality of cartridges with a dispensing outlet of the dispensing system; and a shuttle adjacent the carousel, wherein when the carousel is in a first position, a first cartridge of the plurality of cartridges is radially aligned with the dispensing outlet and the shuttle is configured to sequentially vertically align each of the plurality of compartments of the first cartridge with the dispensing outlet;

wherein when the carousel is in a second position, a second cartridge of the plurality of cartridges is radially aligned with the dispensing outlet of the side wall and the shuttle is configured to sequentially vertically align each of the plurality of compartments of the second cartridge with the dispensing outlet; and wherein the dispensing system is configured to dispense a dose only after a predetermined interval of time based on a prescription provided by a prescriber.

7. The dispensing system of claim 6, further comprising a biometric scanner configured to recognize biometric data of a patient, verify the identity of the patient, and authorize a dispense from the dispensing system.

8. The dispensing system of claim 6, further comprising a device key and an ID scanner, wherein the device is configured to unlock the dispensing system and allow a pharmacist to open the dispensing system and fill each of the plurality of compartments and the ID scanner is configured to recognize an ID and authorize use of the device key to unlock the dispensing system.

9. The dispensing system of claim 6, wherein the dispensing system is communicatively coupled to a network and is configured to receive and implement a modified prescription from the prescriber.

10. The dispensing system of claim 6, further comprising a main body, a top cover, and a bottom cover, wherein the carousel and the shuttle are disposed within the main body and the dispensing outlet extends through a side wall of the main body.

11. The dispensing system of claim 10, further comprising a plurality of tamper sensors disposed within the main body and configured to alert a database if a patient attempts to gain access to the interior of the dispensing system without authorization.

12. A dispensing system, comprising:

a main body comprising a top cover, a side wall, and a bottom cover, wherein the side wall has a dispensing outlet; and a carousel disposed within the main body holding a plurality of cartridges, each of the cartridges having a plurality of compartments, wherein the carousel is configured to sequentially align each of the plurality of cartridges with the dispensing outlet; and a shuttle adjacent the carousel, the shuttle configured to sequentially vertically align each of the plurality of compartments with the dispensing outlet;

wherein the dispensing system is configured to dispense a dose only after a predetermined interval of time based on a prescription provided by a prescriber.

13. The dispensing system of claim 12, further comprising a biometric scanner exposed on the main body and configured to verify the identity of the patient and authorize a dispense from the dispensing system through the dispensing outlet.

14. The dispensing system of claim 12, further comprising a plurality of tamper sensors disposed within the main body and configured to alert a database if a patient attempts to gain access to the interior of the dispensing system without authorization.

15. The dispensing system of claim 12, wherein the dispensing system is communicatively coupled to a network and is configured to receive and implement a modified prescription from the prescriber.

16. The dispensing system of claim 12, wherein when the carousel is in a first position, a first cartridge of the plurality of cartridges is radially aligned with the dispensing outlet and the shuttle is configured to sequentially vertically align each of the plurality of compartments of the first cartridge with the dispensing outlet, and wherein when the carousel is in a second position, a second cartridge of the plurality of cartridges is radially aligned with the dispensing outlet of the side wall and the shuttle is configured to sequentially vertically align each of the plurality of compartments of the second cartridge with the dispensing outlet.

17. The dispensing system of claim 12, further comprising a device key configured to unlock the main body and allow a pharmacist to open the dispensing system and fill each of the plurality of compartments.

18. The dispensing system of claim 17, further comprising an ID scanner exposed on the main body and configured to recognize an ID of the pharmacist and authorize use of the device key to unlock the bottom cover of the dispensing system.

* * * * *